US006435082B1

(12) United States Patent
Habara

(10) Patent No.: US 6,435,082 B1
(45) **Date of Patent: *Aug. 20, 2002**

(54) PORTABLE ELECTROPRESSING APPARATUS

(75) Inventor: Naohide Habara, Tokyo (JP)

(73) Assignee: Janome Sewing Machine Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/859,388

(22) Filed: May 20, 1997

(30) Foreign Application Priority Data

May 21, 1996 (JP) ..... 8-125680

(51) Int. Cl.[7] ..... B30B 1/18; B30B 15/04; B30B 7/04

(52) U.S. Cl. ..... 100/208; 72/454; 72/455; 83/631; 83/859; 100/214; 100/231; 100/232; 100/289

(58) Field of Search ..... 100/214, 231, 100/289, 232, 290, 208; 72/454, 455, 462, 481.9; 83/631, 859; 248/645, 678

(56) References Cited

U.S. PATENT DOCUMENTS

| | | | | | |
|---|---|---|---|---|---|
| 698,506 | A | * | 4/1902 | Illingworth | 100/289 |
| 862,581 | A | * | 8/1907 | McKillop | 72/481.9 |
| 3,604,345 | A | * | 9/1971 | Boje | 100/289 |
| 3,643,589 | A | * | 2/1972 | Carter | 100/289 |
| 3,929,000 | A | * | 12/1975 | Kraiowetz | 72/454 |
| 4,781,568 | A | * | 11/1988 | Inaba | 100/290 |
| 5,203,191 | A | * | 4/1993 | Maggi | 72/454 |
| 5,482,454 | A | * | 1/1996 | Miyahara et al. | 100/231 |
| 5,483,874 | A | * | 1/1996 | Shimizu et al. | 100/289 |
| 5,606,910 | A | * | 3/1997 | Katz | 100/208 |

FOREIGN PATENT DOCUMENTS

| | | | | |
|---|---|---|---|---|
| DE | 2431585 | * | 1/1976 | 100/214 |
| DE | 2811352 | * | 9/1979 | 100/232 |
| GB | 15374 | * | 7/1911 | 100/231 |
| JP | 1-210198 | * | 8/1989 | |
| JP | 1-316240 | * | 12/1989 | |

* cited by examiner

*Primary Examiner*—Stephen F. Gerrity
(74) *Attorney, Agent, or Firm*—Lowe Hauptman Gilman & Berner, LLP

(57) ABSTRACT

A portable electropressing apparatus is provided with an installing base having an installing surface extending in a plane in parallel with the axial movement directions (horizontal, vertical and oblique) of a pressing ram so that the apparatus may be may be easily and exactly installed with a variety of positional changes with respect to a workpiece to be pressed, wherein the portable electropressing apparatus comprises an apparatus body; a pressing ram provided in the apparatus body and axially movable to import a required amount of pressure to a workpiece to be pressed; an electric drive motor; a drive mechanism including a threaded drive shaft operatively connected to the electric drive motor to be rotated thereby; a transmission operatively connected to the threaded drive shaft and to the pressing ram to convert the rotational movement of the threaded drive shaft into the axial movement of the pressing ram; and an installing arrangement including the aforementioned installing base formed integral with the apparatus body for installing the portable electropressing apparatus to a platform, the installing base being provided with an installing surface which is extended in a plane in parallel with the axial movement directions of the pressing ram, wherein the installing base is extended axially of the pressing ram in a region substantially covering an entire length of the pressing ram and is extended laterally of the axis of the pressing ram in a region extending at least slightly beyond the apparatus body on both sides thereof, and wherein the installing base has a plurality of notches formed at both sides thereof laterally of the apparatus body, by which to install the apparatus body to the platform.

10 Claims, 4 Drawing Sheets

PORTABLE ELECTROPRESSING APPARATUS

BACKGROUND OF THE INVENTION

The invention relates to a portable electropressing apparatus and more particularly relates to a portable electropressing apparatus capable of being optionally installed so as to change the axial movement directions of the pressing ram so that the pressing ram may perform various operations with respect to a workpiece which is comparatively of smaller type and/or of smaller capacity.

So far many types of electropressing-apparatuses including portable electropressing apparatuses have been proposed. The portable electropressing apparatuses have an installing base provided therewith, which is generally of an installing surface extending vertically of the axial movement directions of the pressing ram.

In case of such a type of portable electropressing apparatus, it is very difficult and troublesome to install the same with the aid of a required attachment or attachments in accordance with required axial movement directions of the pressing ram with respect to a workpiece to be pressed, and the installability is very limited if it is possible.

SUMMARY OF THE INVENTION

The invention has been provided to eliminate the foregoing defects and disadvantages of the prior art. It is therefore a primary object of the invention to provide a portable electropressing apparatus which is provided with an installing base having an installing surface extending in parallel with the axial movement directions of the pressing ram;

It is another object of the invention to provide a portable electropressing apparatus having such an installing base as will enable the apparatus to be optionally installed with a variety of positional changes thereof with respect to a workpiece to be pressed;

It is still another object of the invention to provide a portable electropressing apparatus which is structurally compact and may be easily, fixedly and exactly installed at any positions with respect to a workpiece to be pressed.

The invention satisfies the foregoing objects through a portable electropressing apparatus comprising an apparatus body, a pressing ram provided in the apparatus body and axially driven to import a required amount of pressure to a workpiece to be pressed; driver means for driving the pressing ram in the axial directions thereof with respect to the workpiece, the driver means including an electric motor, a motor driver for driving the electric motor, a transmission mechanism provided in the apparatus body and operatively connected to the pressing ram and to the driver mechanism to change the rotational drive movements of the electric motor into straight-line drive movements of the pressing ram; and an installing base formed integral with the apparatus body for installing the portable electropressing apparatus to a platform, the installing base being provided with an installing surface which is extended in parallel with the axial movement directions of said pressing ram.

The installing base is extended axially of said pressing ram in a region substantially covering an entire length of the pressing ram and is extended laterally of the pressing ram in a region extending slightly beyond said apparatus body on both sides thereof.

The installing base has a plurality of notches formed at both sides thereof laterally of said apparatus body, by which to install the apparatus to the platform.

Figure 1:
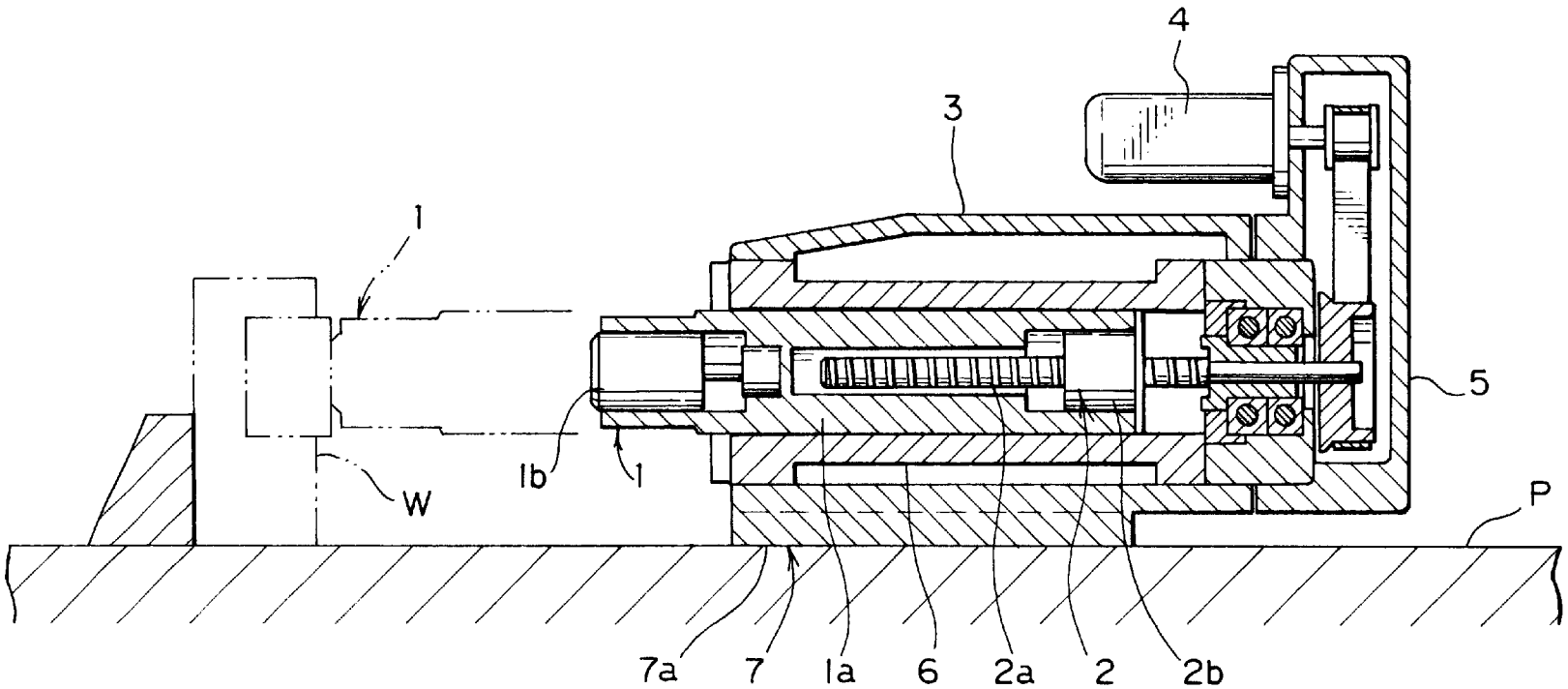
FIG. 1 is a side elevational view of a portable electropressing apparatus of the invention mounted to a horizontal surface of a platform with respect to a workpiece to be pressed and shown in vertical section.
Figure 2:
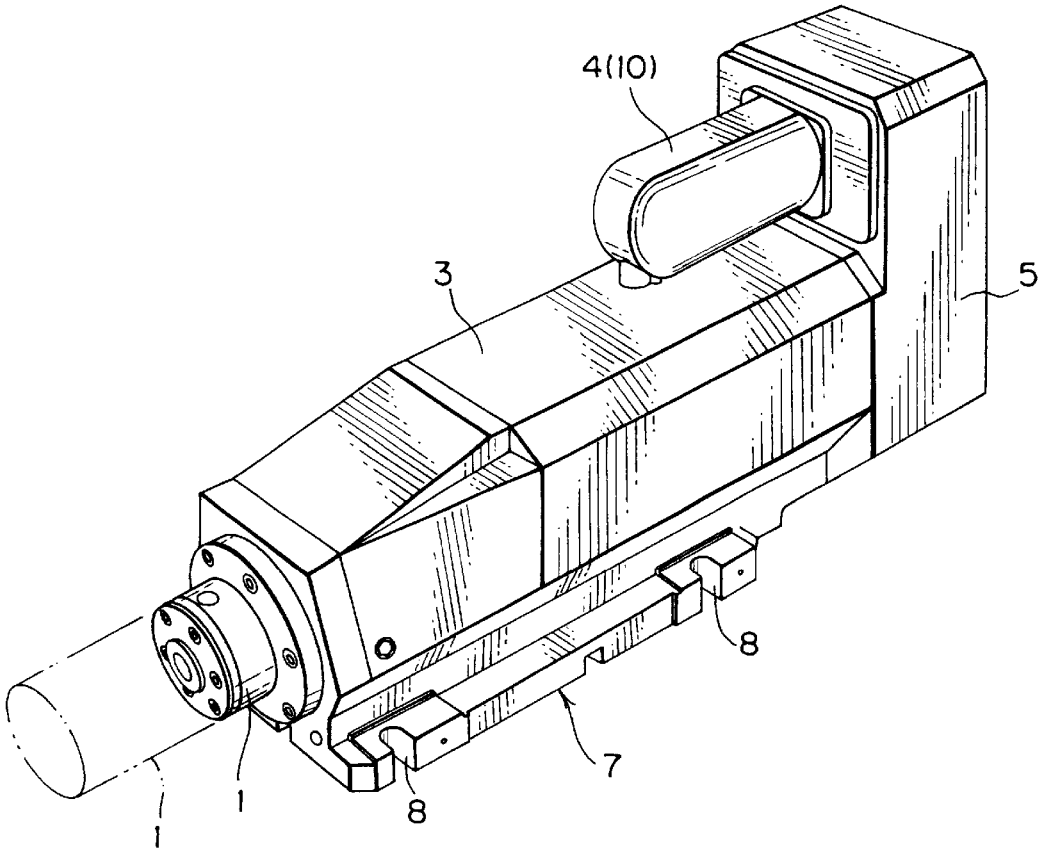
FIG. 2 is a perspective view of the apparatus.

DETAILED DESCRIPTION OF THE PREFERRED EMBODIMENT:

A preferred embodiment is depicted in FIGS. 1 and 2, wherein the portable electropressing apparatus of the invention comprises a drive mechanism including a transmission mechanism for changing rotational drive movements of a shaft into axial straight-line drive movements (horizontal, vertical and oblique directions) of a pressing ram 1. The transmission mechanism substantially comprises a threaded ball-bearing drive shaft 2 which is incorporated in an apparatus body 3, so that the pressing ram 1, which is operatively connected to the threaded ball-bearing drive shaft 2, may be driven in axial straight-line movements to apply a desired amount of pressure to a workpiece W which is comparatively of smaller type and/or of smaller capacity. An electric motor 4, as a drive source, is provided within a casing 5 which is mounted to the apparatus body 3 at one end thereof. The electric motor 4 is operatively connected to the threaded ball bearing drive shaft 2 through pulleys and a transmission belt.

The pressing ram 1 is formed in a ram cylinder 1*a* having a hollow axially extending passage designed to axially receive therein the threaded ball-bearing drive shaft 2 which is composed of a threaded drive shaft 2*a* and a nut block 2*b* in threaded engagement with the shaft 2*a* through plural ball-bearings (not shown) arranged in fitted engagement with the threads between the threaded drive shaft 2*a* and the nut block 2*b*. The hollow passage is diametrically enlarged at one end part thereof which receives therein the nut block 2*b* to enable the nut block to be secured to one end part of the ram cylinder 1*a*.

One end part of the threaded drive shaft 2*a* is jounalled in a bearing in the apparatus body 3 at one end thereof and operatively connected to the electric drive motor 4 by means of a transmission belt. The rotational movement of the threaded drive shaft 2*a* is transmitted to the nut block 2*b* through the ball-bearings. As the result, the nut block 2*b* is moved axially by the threaded drive shaft 2*a*. The ram cylinder 1*a* moves axially with the nut block 2*b* relative to the workpiece W.

The ram cylinder 1*a* has a press member 1*b* detachably mounted to the opposite end thereof to import a desired amount of pressure to the workpiece W as the cylinder moves axially towards the workpiece W. The press member 1*b* may have a strain gauge mounted thereon for detecting a pressure imported to the workpiece W.

The ram cylinder 1*a* is received within a cylindrical guide 6 fixedly arranged in the apparatus body 3 so that the ram cylinder 1*a* may be axially slidably moved along an inner peripheral wall of the cylindrical guide 6.

The pressing ram 1 is prevented from making rotational movement in a plane vertical to the axis of the pressing ram 1 by means of a suitable device (not shown).

In reference further to FIGS. 1, 2, 3 and 4, the apparatus body 3 is provided with an installing base 7 which has an installing bottom surface 7*a* extending in parallel with axis of the pressing ram 1. The installing base is extended axially of the pressing ram 1 in a region substantially covering the entire axial length of the pressing ram 1, and is extended laterally of the axis of the pressing ram 1 in a region extending at least slightly beyond the apparatus body 3 on both sides thereof.

Figure 3:
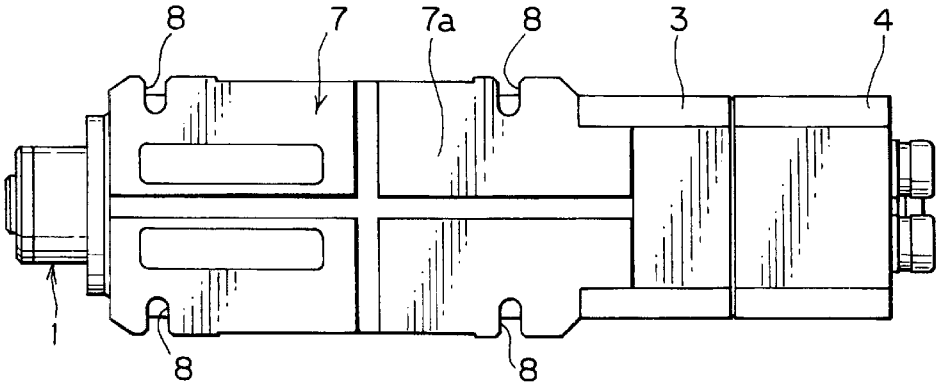
FIG. 3 is a bottom plan view of the apparatus.
Figure 4:
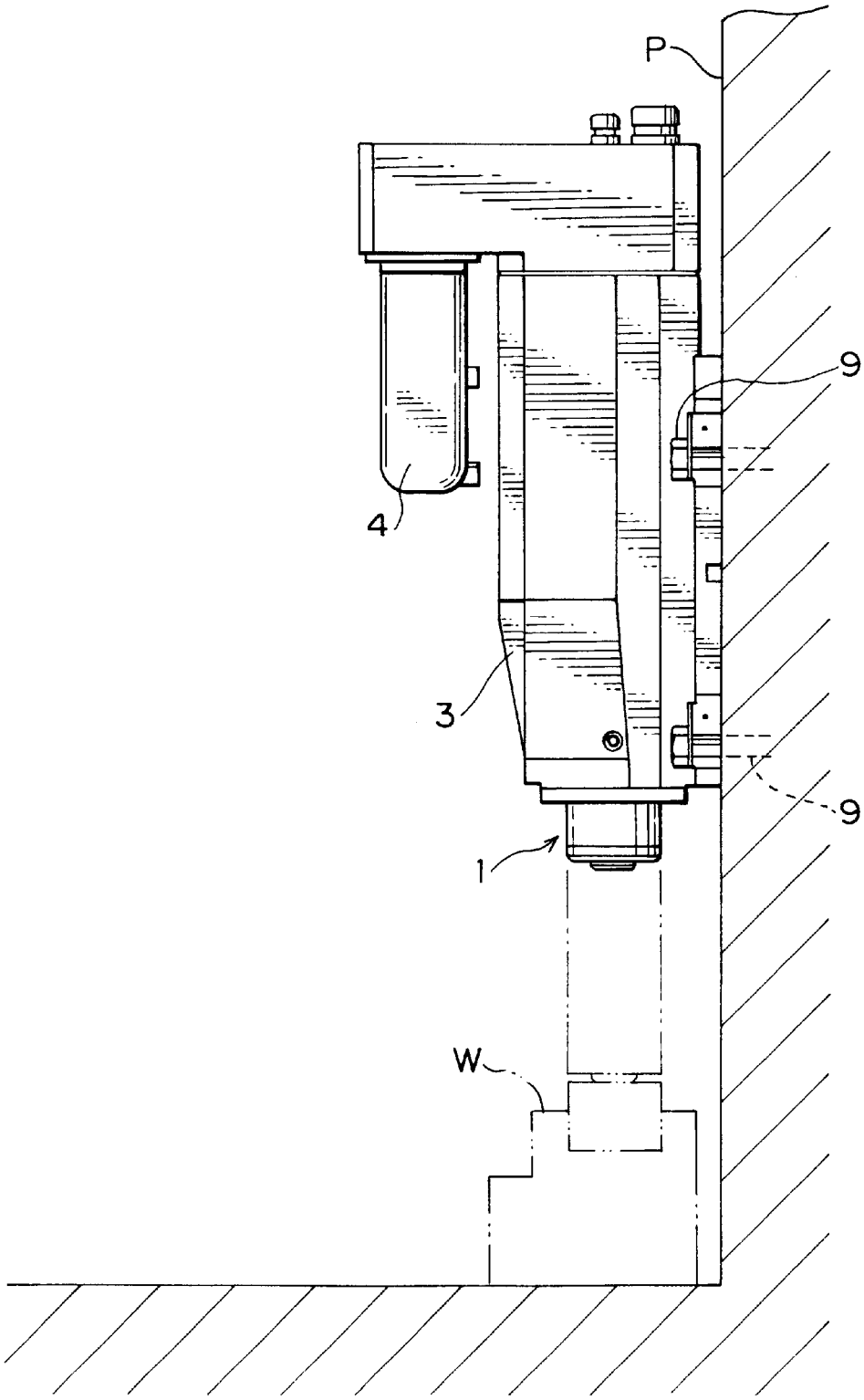
FIG. 4 is a side elevational view of the apparatus mounted to a vertical surface of a platform with respect to a workpiece to be pressed and partly shown in vertical section.

The installing base 7 has a plurality of notches 8 formed at the opposite sides thereof laterally of the apparatus body 3 as particularly shown in FIGS. 2 and 3, by which the electropressing apparatus 3 is fixedly mounted to a platform P by means of a plurality of bolts 9 or the like as shown in FIG. 4. It is needless to say that these notches may be replaced by so many holes or the like.

The electric motor 4 is driven by a motor driver 10, the operations of which are programmed by a central processing unit (CPU). Namely the required axial positions of the pressing ram 1(upper limit position, lower limit position, press starting position immediately above the workpiece, position at which the pressing ram has completely imported pressure to the workpiece), the movement speed of the pressing ram and further the pressing amount of pressure of the pressing ram may be programmingly controlled, at a control board (not shown) which is provided with switches, buttons and the like in a required manner to be optionally manipulated to operate the CPU and is installed separately from the apparatus body 3.

Figure 5:
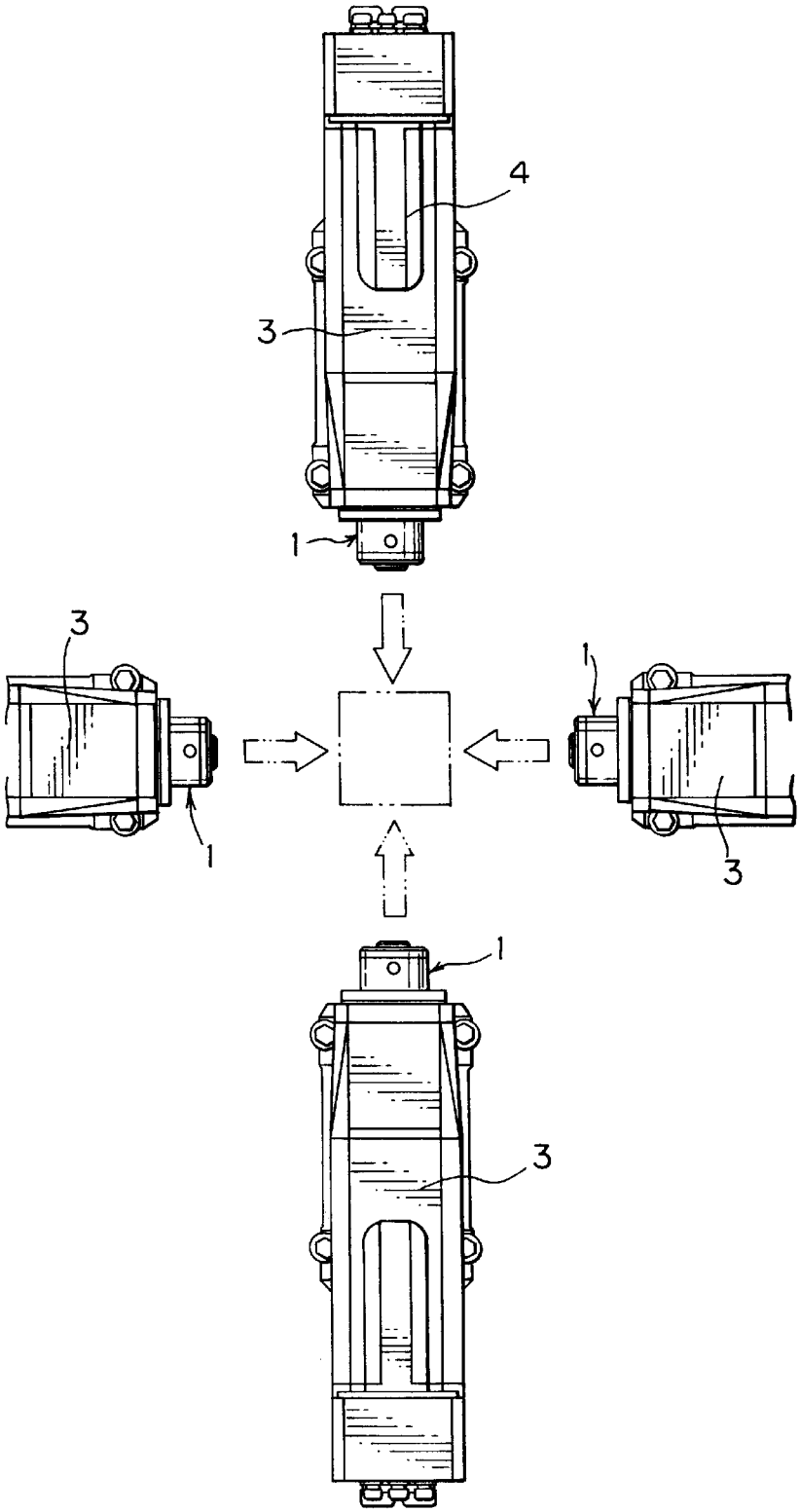
FIG. 5 is a top plan view of four of the apparatuses arranged radially of a workpiece to be pressed.

The portable electropressing apparatus of the invention may be singly installed on a horizontally directed surface of the platform P with respect to the workpiece W to be pressed as shown in FIG. 1, or a plurality of the portable electropressing apparatuses may be installed on the platform around the workpiece to be pressed as shown in FIG. 5, so that the apparatuses may be simultaneously driven to import so many pressures to the workpiece from so many directions. It is needless to say that the portable electropressing apparatus of the invention may be installed on a vertically or obliquely directed surface of the platform P.

What is claimed is:

1. A portable electropressing apparatus comprising an apparatus body, a pressing ram mounted within said apparatus body and being axially movable to apply a required amount of pressure to a workpiece to be pressed, an installing base formed integral with said apparatus body for installing said portable electropressing apparatus to a platform, said installing base being provided with an installing surface extending in a plane parallel with the axial movement directions of said pressing ram;

said installing base being provided in relation to said pressing ram and also extending laterally of said pressing ram in a region outwardly of said apparatus body on both sides thereof;

said installing base having a plurality of open notches formed at both sides thereof laterally of said apparatus body, to install said apparatus body to said platform;

an electric drive motor mounted on said apparatus body and thereby being supported on said installing base through said apparatus body;

a drive mechanism including a threaded drive shaft operatively connected to said electric drive motor to be rotated thereby; and a transmission operatively connected to said threaded drive shaft and to said pressing ram to convert rotational movement of said threaded drive shaft into the axial movement of said pressing ram.

2. The apparatus of claim 1, wherein said motor has a longitudinal axis parallel to the ram axis.

3. The apparatus of claim 1, further comprising a casing mounted to the apparatus body at one end thereof, said electric motor being provided within said casing.

4. In combination, a plurality of said portable electropressing apparatus of claim 1, wherein the installing surfaces of each said apparatus are respectively mounted to a common support surface such that the respective rams of said apparatus can act upon a common object.

5. The combination of claim 4, wherein said respective rams extend in a common plane with each other.

6. The combination of claim 4, wherein said plural portable electropressing apparatus are disposed at 90° intervals from each other relative to said common object.

7. The portable electropressing apparatus of claim 1, wherein said pressing ram is an electropressing ram.

8. A portable electropressing apparatus comprising an apparatus body, a pressing ram mounted within said apparatus body and being axially movable to apply a required amount of pressure to a workpiece to be pressed, an installing base formed integral with said apparatus body for installing said portable electropressing apparatus to a platform said installing base being provided with an installing surface extending in a plane parallel with the axial movement directions of said pressing ram, said installing base extending axially in relation to said pressing ram in a region substantially covering an entire length of said pressing ram and also extending laterally of the axis of said pressing ram in a region extending laterally outward from said apparatus body on both sides thereof;

said installing base having a plurality of open notches formed at both sides thereof laterally of said apparatus body, to install said apparatus body to said platform; an electric drive motor mounted on said apparatus body and thereby being supported on said installing base through said apparatus body; a drive mechanism including a treaded drive shaft operatively connected to said electric drive motor to be rotated thereby, and a transmission operatively connected to said threaded drive shaft and to said pressing ram to convert rotational movement of said threaded drive shaft into the axial movement of said pressing ram, wherein said electric motor is located above both said pressing ram and said installing base.

9. The apparatus of claim 8, wherein said motor is located at an uppermost elevational portion of said apparatus.

10. The portable electropressing apparatus of claim 8, wherein said pressing ram is an electropressing ram.

* * * * *